US009167953B2

(12) United States Patent
Burrows et al.

(10) Patent No.: US 9,167,953 B2
(45) Date of Patent: Oct. 27, 2015

(54) DISHWASHER WITH A MANIFOLD ASSEMBLY CONFIGURED TO ATTACH A MANIFOLD TO A DISH RACK AND ASSOCIATED METHOD

(75) Inventors: James Burrows, Winterville, NC (US); Ralph A. Porcaro, II, Clayton, NC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 1025 days.

(21) Appl. No.: 12/986,566

(22) Filed: Jan. 7, 2011

(65) Prior Publication Data

US 2012/0174951 A1 Jul. 12, 2012

(51) Int. Cl.
*A47L 15/50* (2006.01)

(52) U.S. Cl.
CPC ..... *A47L 15/508* (2013.01); *A47L 15/507* (2013.01)

(58) Field of Classification Search
CPC ..... A47L 11/4088; A47L 15/18; A47L 15/20; A47L 15/22; A47L 15/507; A47L 15/508; A47L 15/4214
USPC ..... 134/56 D, 57 D, 58 D, 144, 145, 163, 134/165, 177
See application file for complete search history.

(56) References Cited

U.S. PATENT DOCUMENTS

| | | | | |
|---|---|---|---|---|
| 3,951,684 | A * | 4/1976 | LaPrad et al. | 134/144 |
| 4,064,887 | A | 12/1977 | Geiger et al. | |
| 5,331,986 | A | 7/1994 | Lim et al. | |
| 5,427,129 | A * | 6/1995 | Young, Jr. et al. | 134/176 |
| 7,055,537 | B2 | 6/2006 | Elick et al. | |
| 7,100,623 | B2 | 9/2006 | Assmann et al. | |
| 7,225,818 | B2 | 6/2007 | Kim et al. | |
| 7,754,024 | B2 | 7/2010 | Koch et al. | |
| 2007/0215187 | A1 | 9/2007 | Koch et al. | |
| 2007/0295361 | A1 | 12/2007 | Thyagarajan et al. | |
| 2008/0142056 | A1 | 6/2008 | Dries et al. | |
| 2010/0101611 | A1 | 4/2010 | Chen et al. | |
| 2010/0139719 | A1 | 6/2010 | Gnadinger et al. | |
| 2010/0147339 | A1 | 6/2010 | Bertsch et al. | |

FOREIGN PATENT DOCUMENTS

| | | | |
|---|---|---|---|
| DE | 3110299 | A1 | 10/1982 |
| DE | 3702829 | C1 | 2/1988 |
| DE | 4341682 | A1 | 6/1995 |
| DE | 19642911 | A1 | 4/1998 |

(Continued)

OTHER PUBLICATIONS

International Search Report and Written Opinion for Patent Application PCT/US2012/020180, dated Jul. 18, 2012.

*Primary Examiner* — David Cormier
(74) *Attorney, Agent, or Firm* — Alston & Bird LLP

(57) ABSTRACT

According to embodiments of the present invention, a dishwasher may include a manifold assembly including a manifold and an attachment assembly. The manifold may provide a fluid connection with a fluid supply and direct fluid from the fluid supply to a spray device. The attachment assembly may couple the manifold to a dish rack. Further, the attachment assembly may facilitate movement of the dish rack relative to the manifold between a retracted position and an extended position while maintaining the fluid connection with the fluid supply. The attachment assembly may include at least one sliding rail and a first plurality of engagement members that couple the sliding rail to the dish rack. Additionally, a second plurality of engagement members may couple the manifold and the sliding rail so as to allow movement along the sliding rail along a major axis of the sliding rail.

18 Claims, 6 Drawing Sheets

(56) References Cited

FOREIGN PATENT DOCUMENTS

| | | | |
|---|---|---|---|
| DE | 19705548 | A1 | 8/1998 |
| DE | 202007002454 | U1 | 5/2007 |
| EP | 1136030 | A1 | 9/2001 |
| GB | 1113514 | A | 5/1968 |
| GB | 2001522 | A | 2/1979 |
| GB | 2200535 | A | 12/1987 |
| WO | WO-2009/004034 | A1 | 1/2009 |

* cited by examiner

DISHWASHER WITH A MANIFOLD ASSEMBLY CONFIGURED TO ATTACH A MANIFOLD TO A DISH RACK AND ASSOCIATED METHOD

BACKGROUND OF THE INVENTION

I. Field of the Invention

Embodiments of the present invention are generally related to manifold assemblies for dishwashers and, more particularly, to a manifold assembly configured to provide a fluid connection with a fluid supply and direct a fluid from the fluid supply to a spray device of a dishwasher.

II. Description of Related Art

One issue of interest in the field of dishwashers is to provide for movement of a dish rack. In this regard, dish racks may be configured to slide in and out of the washing chamber to facilitate loading and unloading of dishware. In some dishwashers a middle spray arm may be positioned above a lower dish rack and below an upper dish rack. The middle spray arm may direct water and soap from a fluid supply toward dishware in the upper dish rack and/or dishware in the lower dish rack. However, supporting the middle spray arm may present difficulties given the position of the middle spray arm between the two extendable dish racks.

In this regard, one solution may be to attach the middle spray arm to a manifold that is fixed to the upper dish rack and travels therewith from a retracted position, to an extended position. In order for a manifold directly affixed to the upper spray rack to direct fluid from the fluid supply to the upper spray arm, a releasable connection between the manifold and the fluid supply may be required. However, a releasable connection may present the possibility for leaks. Further, when the upper dish rack is height adjustable, this may complicate the releasable connection.

BRIEF SUMMARY OF THE INVENTION

The above and other needs are met by embodiments of the present invention which, in one aspect, provides a manifold assembly. In one embodiment, the manifold assembly comprises a manifold configured to provide a fluid connection with a fluid supply and direct a fluid from the fluid supply to a spray device, and an attachment assembly configured to couple the manifold to a dish rack. The attachment assembly may be further configured to facilitate movement of the dish rack relative to the manifold between a retracted position and an extended position while maintaining the fluid connection with the fluid supply. The attachment assembly may be coupled to the manifold such that the manifold and the spray device are disposed beneath the dish rack.

In one aspect the attachment assembly may comprise at least one sliding rail, a first plurality of engagement members configured to couple the sliding rail to the dish rack, and a second plurality of engagement members configured to couple to the manifold and the sliding rail so as to allow movement along the sliding rail along a major axis of the sliding rail. Contact between one of the first plurality of engagement members and one of the second plurality of engagement members may define a dish rack travel limit for movement of the dish rack between the retraction position and the extended position. For example, one of the first plurality of engagement members may be configured to contact one of the second plurality of engagement members when the dish rack is configured in the retracted position. By way of further example, one of the first plurality of engagement members may be configured to contact one of the second plurality of engagement members when the dish rack is configured in the extended position.

In a further aspect, the first plurality of engagement members may be configured to engage a plurality of dish rack members defined by the dish rack that are disposed substantially perpendicularly to the major axis of the sliding rail. Further, the first plurality of engagement members may comprise a plurality of clips configured to attach to the dish rack, and the second plurality of engagement members may comprise a plurality of clips configured to releasably and slidably engage the sliding rail. Additionally, the attachment assembly may comprise a second sliding rail positioned substantially parallel to the sliding rail. The attachment assembly may further comprise a plurality of coupling members configured to couple the second plurality of engagement members to the manifold. The coupling members may be configured to couple to the manifold via an interference fit.

In an additional aspect, at least a portion of the manifold may comprise a flexible section configured to provide for height adjustment of the dish rack. The flexible section of the manifold may comprise a rubber hose. Further, a fluid connector may be configured to couple to the fluid supply, wherein the flexible section of the manifold is configured to engage the fluid connector. The manifold may further comprise a substantially rigid section, wherein the flexible section of the manifold is disposed between the substantially rigid section of the manifold and the fluid connector.

In a further embodiment a dishwasher is provided. The dishwasher may comprise a washing chamber, a dish rack disposed in the washing chamber, a spray device disposed in the washing chamber, a fluid supply configured to supply a fluid, and a manifold assembly. The manifold assembly may comprise a manifold coupled to the fluid supply so as to provide a fluid connection therewith, the manifold configured to direct the fluid from the fluid supply to the spray device, and an attachment assembly coupling the manifold to the dish rack. The attachment assembly may be configured to facilitate movement of the dish rack relative to the manifold between a retracted position and an extended position while maintaining the fluid connection with the fluid supply. Further, the manifold may comprise a flexible section configured to provide for height adjustment of the dish rack within the washing chamber.

In an additional embodiment a method for assembling a dishwasher is provided. The method may comprise providing a dishwasher comprising a washing chamber, a dish rack disposed in the washing chamber, a spray device disposed in the washing chamber, and a fluid supply configured to supply a fluid to the spray device. Further, the method may include coupling a manifold to the fluid supply so as to establish a fluid connection therewith, and attaching the manifold to the dish rack so as to facilitate movement of the dish rack relative to the manifold between a retracted position and an extended position while maintaining the fluid connection with the fluid supply. Attaching the manifold to the dish rack may comprise coupling a first plurality of engagement members to a sliding rail and the dish rack, and coupling a second plurality of engagement members to the manifold and the sliding rail so as to allow movement along the sliding rail along a major axis of the sliding rail.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
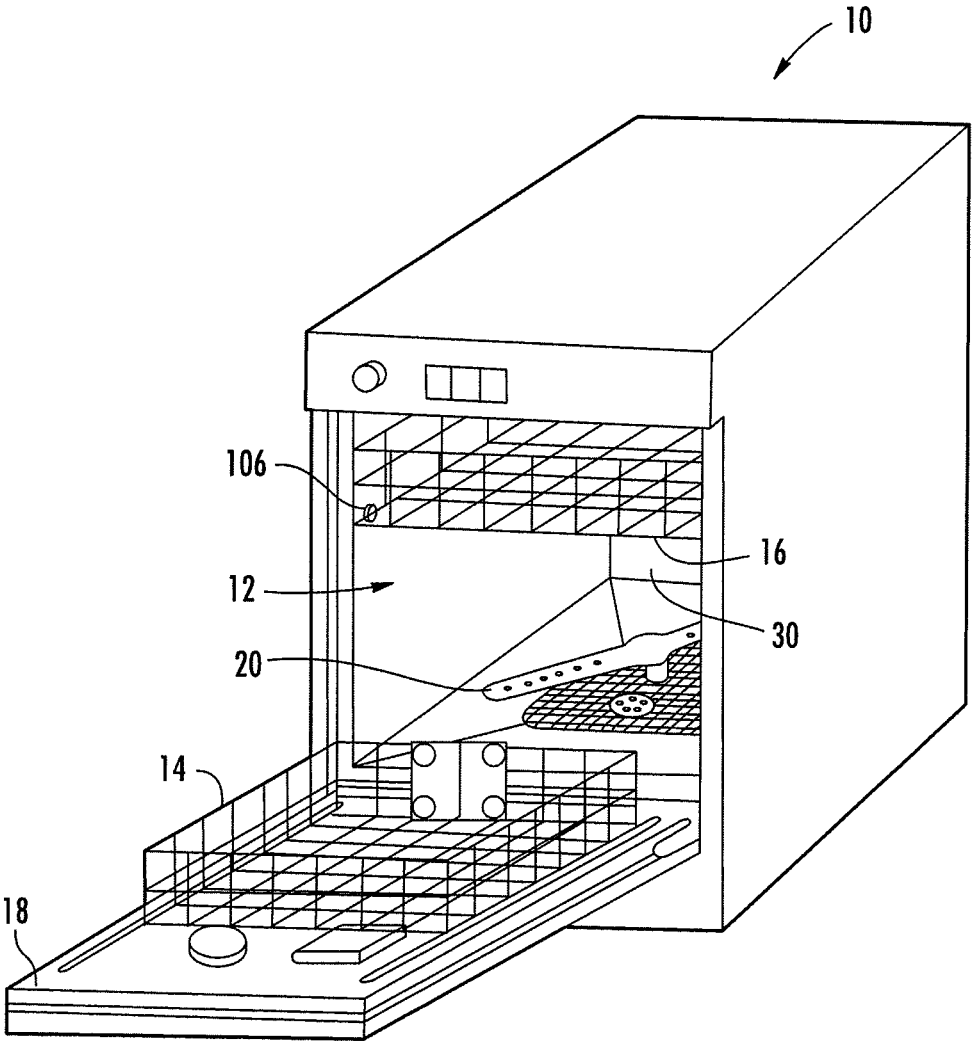
FIG. 1 illustrates a perspective view of a dishwasher comprising an upper dish rack and a lower dish rack according to an embodiment of the invention.

FIG. 1 shows one embodiment of a dishwasher 10. The dishwasher 10 may comprise a washing chamber 12 in which dishware or other items may be inserted in a lower dish rack 14 and an upper dish rack 16. The dish racks 14, 16 may be configurable to move between extended and retracted positions. For example, the lower dish rack 14 is illustrated in an extended position wherein the lower dish rack at least partially extends out of the washing chamber 12. When the dish racks 14, 16 are in the extended positions, loading of dishware into the dish racks may be facilitated due to increased ease of access. Conversely, the upper dish rack 16 is illustrated in a retracted position. When the dish racks 14, 16 are in the retracted positions, a door 18 of the dishwasher 10 may be closed so as to substantially seal the washing chamber 12. Thereafter, one or more spray devices such as the illustrated lower spray arm 20 may direct water so as to clean the items in the washing chamber 12. In some embodiments the lower spray arm 20 and/or other spray devices may rotate so as to direct the fluid at substantially all of the items in the wash chamber 12.

Note that the terms dishwasher and dish rack, as used herein, are not intended to limit the scope of the invention to embodiments of apparatuses, systems, and methods relating to washing dishware. Rather, the dishwasher 10 provided herein may be configured to hold and wash items in the dish racks 14, 16 in addition to, or instead of, dishware. By way of example, the dishwasher 10 may be configured to wash lab equipment, clothing items, medical instruments, etc. in the dish racks 14, 16. Further, embodiments disclosed herein may be applicable to other washing appliances that supply fluid via a manifold.

Figure 2:
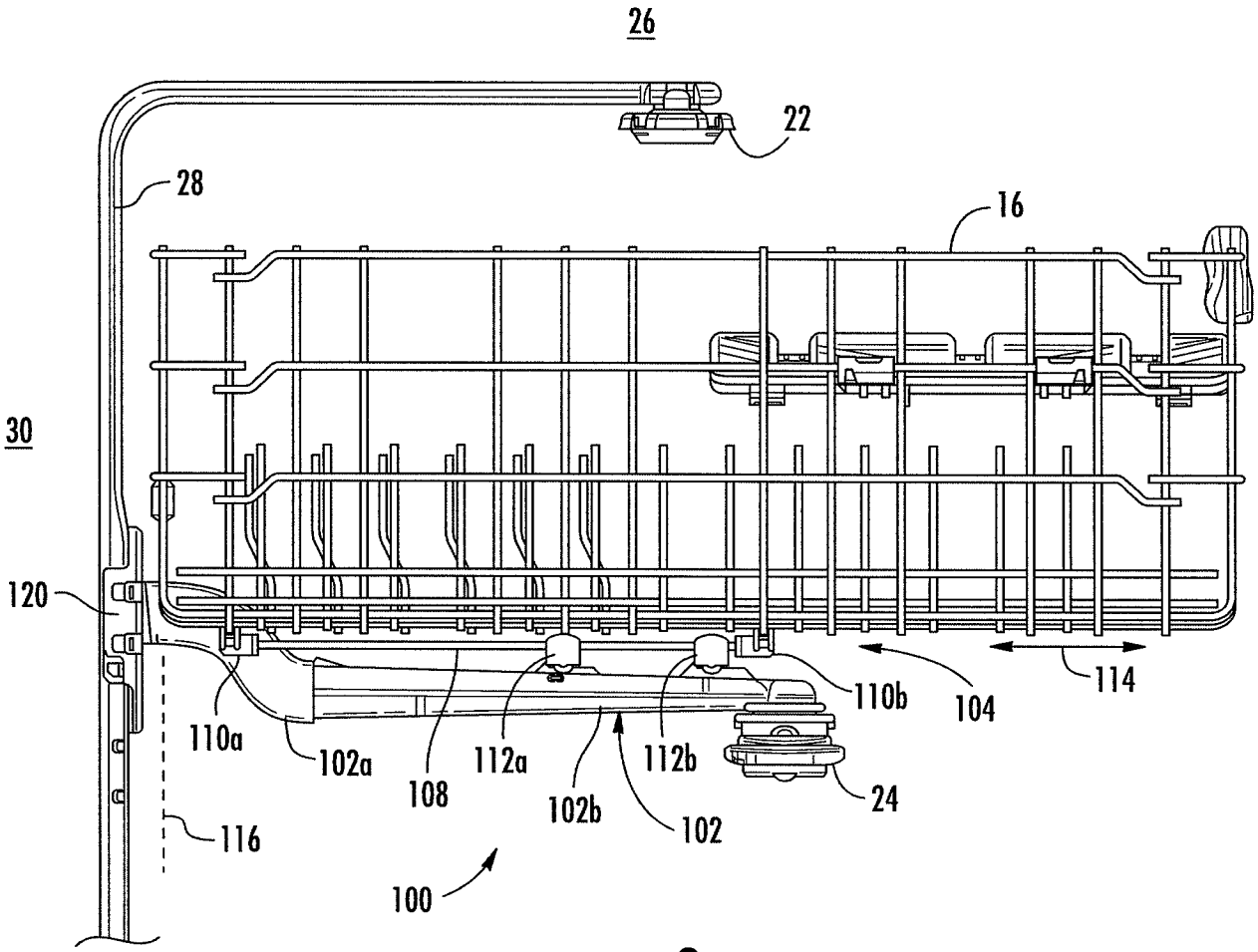
FIG. 2 illustrates a side view of a manifold assembly and the upper dish rack of FIG. 1 in a retracted position according to an exemplary embodiment of the present invention.

Although not illustrated in FIG. 1, in some embodiments the dishwasher 10 may additionally or alternatively comprise other spray devices. In this regard, FIG. 2 illustrates a side view of an upper spray arm 22 and a middle spray arm 24 as they may be positioned with respect to the upper dish rack 16 of FIG. 1. As illustrated, the upper spray arm 22 may be positioned above the upper dish rack 16 and in some embodiments the upper spray arm may attach to an upper wall 26 defining the wash chamber 12. Thereby, the upper spray arm 22 may direct fluid from a fluid supply 28 into the wash chamber 12 so as to wash dishware in the upper rack 16. The fluid supply 28 may in some embodiments comprise a conduit mounted to a rear wall 30 of the dishwasher 10 that is positioned opposite to the door 18 (see, e.g. FIG. 1). As discussed above with respect to the lower spray arm 20, the middle spray arm 24 and the upper spray arm 22 may comprise rotating spray arms in some embodiments.

Embodiments of the dishwasher 10 comprise a manifold assembly 100 that is configured to prevent leaks and avoid complications associated with some existing embodiments of dishwashers. As illustrated in FIG. 2, the manifold assembly 100 includes a manifold 102 and an attachment assembly 104. The manifold 102 may be configured to provide a fluid connection with the fluid supply 28 and further configured to direct a fluid from the fluid supply to a spray device such as the middle spray arm 24. The attachment assembly 104 may be configured to attach the manifold 100 to a dish rack such as the upper dish rack 16 so as to support the manifold therefrom. For example, in the illustrated embodiment, the attachment assembly 104 is configured to dispose the manifold 102 and the middle spray arm 24 beneath the upper dish rack 16. Note that while the attachment assembly 104 is generally described herein as being employed to attach the manifold 102 to the upper dish rack 16, the attachment assembly may be employed to attach the manifold to other dish racks, such as the lower dish rack 14, in other embodiments. Further, in some embodiments the manifold may be self-supported such that the attachment assembly facilitates movement of the dish rack relative to the manifold.

The attachment assembly 104 may be further configured to provide for movement of the upper dish rack 16 relative to the manifold 102 between a retracted position (see FIG. 2) and an extended position (see FIG. 3) while maintaining the fluid connection with the fluid supply 28. Thus, the manifold 102 remains connected and in fluid communication with the fluid supply 28 regardless of the position of the upper dish rack 16. The upper dish rack 16 may ride on a set of wheels 106 (see FIG. 1) or comprise other features that support the upper dish rack and allow movement of the upper dish rack. Further, as noted above, movement of the upper dish rack 16 may be relative to the manifold 102. Thus, the manifold 102 may remain substantially stationary as the upper dish rack 16 moves from the retracted position to the extended position and vice versa.

Furthermore, the attachment assembly 104 may comprise a sliding rail 108, a first plurality of engagement members 110*a*, 110*b* (collectively 110), and a second plurality of engagement members 112*a*, 112*b* (collectively 112). The first plurality of engagement members 110 may be configured to couple the sliding rail 108 to the upper dish rack 16. Further, the second plurality of engagement members 112 may be configured to engage the manifold 102 and the sliding rail 108 so as to allow movement along the sliding rail along a major axis 114 of the sliding rail. Thus, the sliding rail 108 and the upper dish rack 16 may move between the retracted position and the extended position as respectively illustrated in FIGS. 2 and 3. The sliding rail 108 may be any longitudinal member having a major axis that facilitates movement between the upper dish rack 16 and the manifold 102, while the engagement members 110, 112 may be any number of devices that are configured to operably engage the sliding rail as described herein. In addition, there may be any number of sliding rails 108 (one or more) and engagement members 110, 112 depending on various factors, such as the dish rack and manifold employed.

In some embodiments contact between one of the first plurality of engagement members 110 and one of the second plurality of engagement members 112 may define a dish rack travel limit for movement of the upper dish rack 16. For example, as illustrated in FIG. 2, one of the first plurality of engagement members 110 may be configured to contact one of the second plurality of engagement members 112 in an instance in which the dish rack is configured in the retracted position. In particular, an outer one 110*b* of the first plurality of engagement members 110 may contact an outer one 112*b* of the second plurality of engagement members 112 so as to define a retracted or an inner dish rack travel limit 116. Although the first plurality of engagement members 110 are shown attached at opposite ends of the sliding rail 108, the first plurality of engagement members may be attached at different positions to adjust the relative movement of the upper dish rack 16 with respect to the manifold 102.

Figure 3:
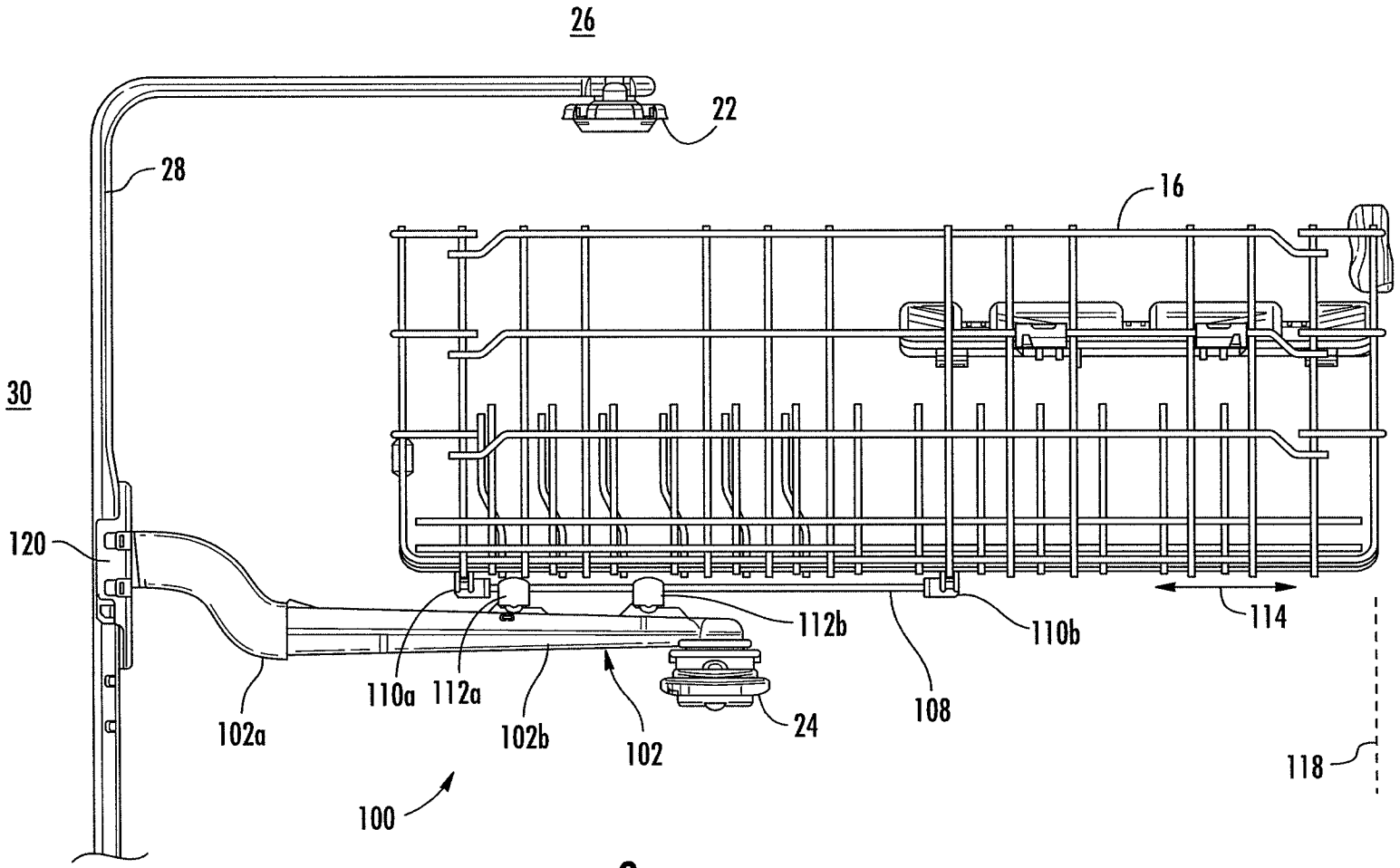
FIG. 3 illustrates a side view of the manifold assembly and the upper dish rack of FIG. 2 in an extended position according to one embodiment of the present invention.

Conversely, as illustrated in FIG. 3, one of the first plurality of engagement members 110 may be configured to contact one of the second plurality of engagement members 112 in an instance in which the dish rack is in the extended position. In particular, an inner one 110*a* of the first plurality of engagement members 110 may contact an inner one 112*a* of the second plurality of engagement members 112 so as to define an extended or outer dish rack travel limit 118. Note that in the illustrated embodiments a small amount of separation is shown between the first plurality of engagement members 110 and the second plurality of engagement members 112 in the retracted and extended positions so as to illustrate that these are separate components.

As noted above, the manifold 102 may be configured to maintain a fluid connection with the fluid supply 28 despite movement of the upper dish rack 16 between the retracted position and the extended position. Thus, rather than using a releasable connection, the manifold assembly 100 may comprise a fluid connector 120 configured to continuously couple the fluid supply 28 to the manifold 102, although in other embodiments the manifold may engage the fluid supply 102 directly. In some embodiments the manifold 102 may comprise a flexible section 102*a* and a substantially rigid section 102*b*. The flexible section 102*a* may comprise various flexible materials such as a rubber hose, and the substantially rigid section 102*b* may be formed from a plastic material in some embodiments, although various other materials may be employed in alternate embodiments as may be understood by one having skill in the art. The flexible section 102*a* of the manifold 102 may be disposed between the substantially rigid section 102*b* of the manifold and the fluid connector 120 such that the flexible section of the manifold is configured to engage the fluid connector. It is understood that the manifold 102 may be formed of various relative portions of flexible and rigid sections, and in one embodiment the manifold may be formed entirely of flexible material.

The flexible section 102*a* of the manifold 102 may be configured to accommodate height adjustment of the upper dish rack 16. For example, the flexible section 102*a* of the manifold 102 may flex and bend so as to allow the upper dish rack 16 to be moved between various heights within the washing chamber 12. For example, FIGS. 2 and 3 illustrate the upper dish rack 16 at a lower height level with the flexible section 102*a* of the manifold 102 bent downwardly. Conversely, when the upper dish rack 16 is lifted to a higher position, the flexible section 102*a* of the manifold 102 may straighten or bend upwardly to accommodate this position.

Figure 4:
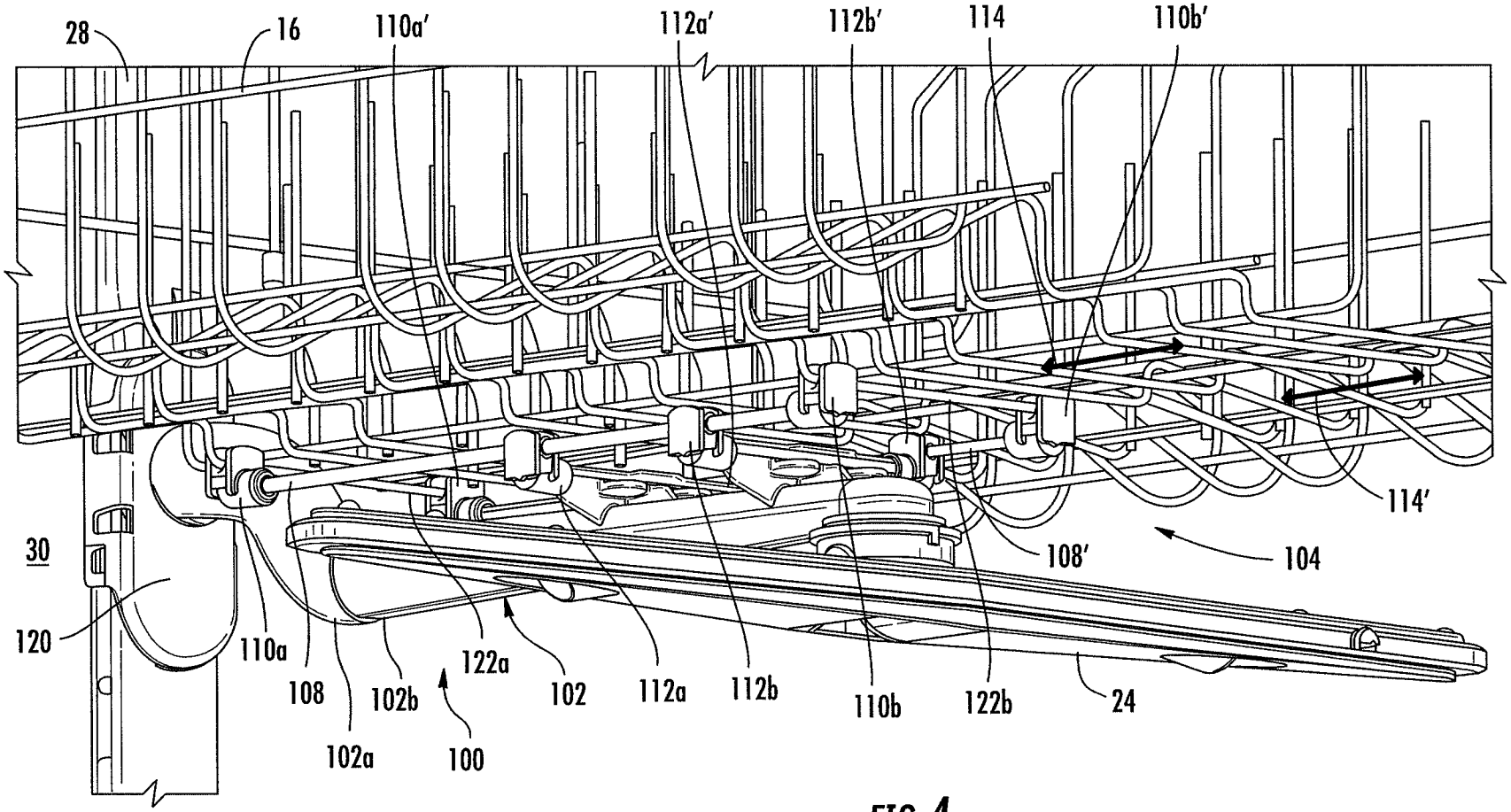
FIG. 4 illustrates an enlarged perspective view of the underside of the manifold assembly and the upper dish rack of FIG. 2 according to one embodiment of the present invention.

FIG. 4 illustrates an enlarged perspective view from underneath the upper dish rack 16 and the manifold assembly 100. As illustrated, the attachment assembly 104 may further comprise a second sliding rail 108' in some embodiments. The second sliding rail 108' may be positioned substantially in parallel with the sliding rail 108 (i.e. the "first sliding rail") in some embodiments. For example, the sliding rails 108 could be positioned symmetrically opposite one another with respect to the manifold 102.

A first plurality of engagement members 110*a*', 110*b*' (collectively 110') may be configured to couple the second sliding rail 108' to the upper dish rack 16. Further, a second plurality of engagement members 112*a*', 112*b*' (collectively 112') may be configured to engage the manifold 102 and the second sliding rail 108' so as to allow for movement along the second sliding rail along a major axis 114' of the second sliding rail. Thus, the attachment assembly 104 may comprise two sliding rails 108, 108' with respective first 110, 110' and second 112, 112' pluralities of engagement members in some embodiments. The manifold 102 may thereby be further supported in some embodiments.

Figure 5:
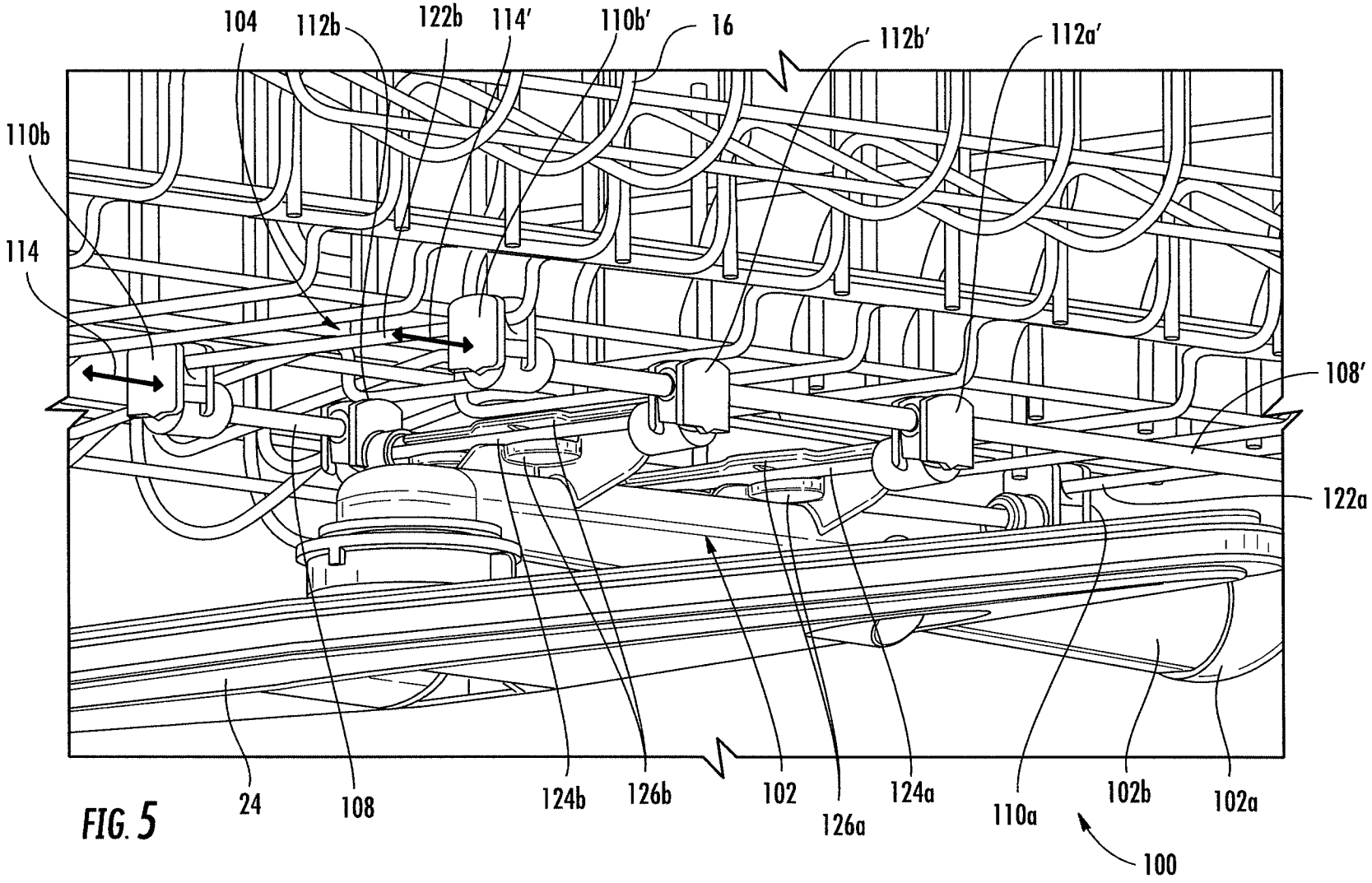
FIG. 5 illustrates a further enlarged view of the underside of the manifold assembly and upper dish rack of FIG. 2 from an alternate perspective according to one embodiment of the present invention.

FIG. 5 illustrates an alternate enlarged perspective view of a portion of the middle spray arm 24 and the manifold assembly 100. In particular, one embodiment of the attachment assembly 104 is illustrated in further detail. As illustrated, the first plurality of engagement members 110, 110' may be configured to engage a plurality of dish rack members 122*a*, 122*b* (collectively 122) defined by the upper dish rack 16 that are disposed substantially perpendicularly to the major axes 114, 114' defined by the sliding rails 108, 108'. Thereby, friction between the second plurality of engagement members 112, 112' and the sliding rails 108, 108' may not displace the first plurality of engagement members 110, 110' from the upper dish rack 16 when the upper dish rack 16 is moved from the retracted position to the extended position, and vice versa.

As illustrated, in some embodiments the first plurality of engagement members 110, 110' may comprise a plurality of clips configured to attach to the upper dish rack 16. Thereby, the first plurality of engagement members 110, 110' may snap onto the dish rack members 122 defined by the upper dish rack 16 and remain attached thereto such as via an interference fit, fasteners, or the like. Thus, the first plurality of engagement members 110, 110' may be fixed in position with respect to the upper dish rack 16. As illustrated, in some embodiments the second plurality of engagement members 112, 112' may additionally or alternatively comprise a plurality of clips configured to releasably engage the sliding rails 108, 108'. In this regard, the sliding rails 108, 108' and the second plurality of engagement members 112, 112' are engaged with one another such that the upper dish rack 16 may move between the retracted and extended positions as described above.

The attachment assembly 104 may further comprise a plurality of coupling members 124*a*, 124*b* (collectively 124) configured to couple the second plurality of engagement members 112, 112' to the manifold 102. For example, in the illustrated embodiment the coupling members 124 comprise rods that extend between pairs (112*b* and 112*b*', 112*a* and 112') of the second plurality of engagement members 112, 112'. By way of further example, the coupling members 124 may be configured to couple to the manifold 102 such as via an interference fit, fasteners, and the like. In the illustrated embodiment the manifold 102 comprises pairs of protrusions 126*a*, 126*b* (collectively 126) that are configured to engage the coupling members 124. Thereby, the coupling members 124 may snap into place between the pairs of protrusions 126 so as to be held therebetween via interference fit.

Figure 6:
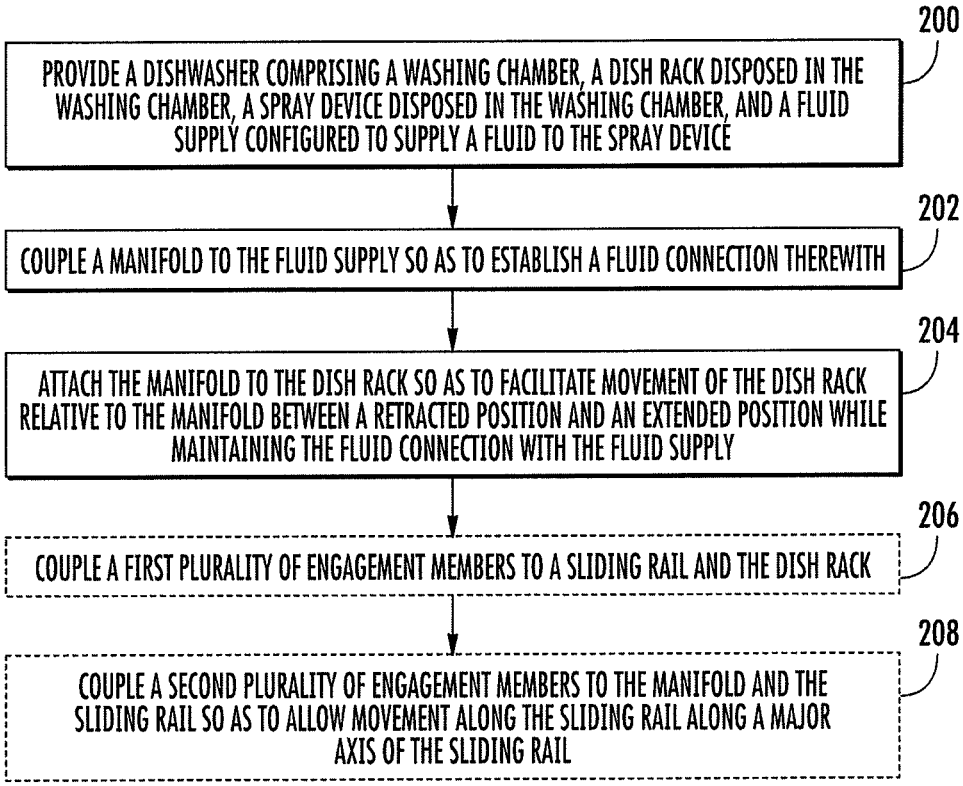
FIG. 6 illustrates a method for assembling a dishwasher according to one embodiment of the present invention.

In a further embodiment a method for assembling a dishwasher is provided. As illustrated in FIG. 6, the method may comprise the steps of providing a dishwasher at block 200. In one embodiment, the dishwasher may comprise the dishwasher 10 described above. Thus, the dishwasher may comprise a washing chamber, a dish rack disposed in the washing chamber, a spray device disposed in the washing chamber, and a fluid supply configured to supply a fluid to the spray device. The method may further comprise coupling a manifold to the fluid supply so as to establish a fluid connection therewith at block 202, and attaching a manifold to the dish rack so as to facilitate movement of the dish rack relative to the manifold between a retracted position and an extended position while maintaining the fluid connection with the fluid supply at block 204.

In some embodiments the method may additionally or alternatively comprise other steps including those operations illustrated in dashed lines in FIG. 6. For example, in one embodiment attaching the manifold to the dish rack at block 204 may comprise coupling a first plurality of engagement members to a sliding rail and the dish rack at block 206, and coupling a second plurality of engagement members to the manifold and the sliding rail so as to allow movement along the sliding rail along a major axis of the sliding rail at block 208.

Accordingly, embodiments of the present invention may provide several advantages. For example, the manifold may remain connected to the fluid supply when the dish rack is moved between the retracted and extended positions, which may reduce the potential for leaks. Further, the manifold may flex so as to allow for height adjustment of the dish rack within the washing chamber without requiring modification to the manifold assembly. Also, height adjustment of the dish rack may occur without disconnecting the manifold from the fluid supply, which may further reduce the potential for leaks. Various other advantages may be provided by the manifold assemblies, dishwashers, and methods disclosed herein as described above and as may otherwise be understood by one having skill in the art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A manifold assembly for a dishwasher, the manifold assembly comprising:

a manifold configured to provide a fluid connection between a fluid supply and a spray device within a washing chamber of the dishwasher, wherein the fluid supply extends vertically along a rear wall of the washing chamber, the manifold is configured to extend forwardly from the fluid supply, and the manifold is further configured to direct a fluid from the fluid supply to the spray device; and an attachment assembly configured to translatably couple the manifold to a dish rack to enable movement of the dish rack relative to the manifold between a retracted position of the dish rack and an extended position of the dish rack, while maintaining the coupling of the manifold to the dish rack and while maintaining fluid connection with the fluid supply, wherein when the dish rack is in the extended position, at least a portion of the dish rack extends outside of the washing chamber to facilitate dishware being loaded and unloaded therefrom, the attachment assembly comprising:

at least one sliding rail, a first plurality of engagement members configured to couple the at least one sliding rail to the dish rack, and a second plurality of engagement members configured to couple to the manifold and the at least one sliding rail so as to allow movement along the at least one sliding rail along a major axis of the at least one sliding rail, wherein contact between one of the first plurality of engagement members and one of the second plurality of engagement members defines a dish rack travel limit for movement of the dish rack between the retracted position and the extended position.

2. The manifold assembly of claim 1, wherein one of the first plurality of engagement members is configured to contact one of the second plurality of engagement members when the dish rack is configured in the retracted position.

3. The manifold assembly of claim 1, wherein one of the first plurality of engagement members is configured to contact one of the second plurality of engagement members when the dish rack is configured in the extended position.

4. The manifold assembly of claim 1, wherein the first plurality of engagement members are configured to engage a plurality of dish rack members defined by the dish rack that are disposed substantially perpendicularly to a major axis of the at least one sliding rail.

5. The manifold assembly of claim 1, wherein the first plurality of engagement members comprise a plurality of clips configured to attach to the dish rack.

6. The manifold assembly of claim 1, wherein the second plurality of engagement members comprise a plurality of clips configured to releasably and slidably engage the at least one sliding rail.

7. The manifold assembly of claim 1, wherein the at least one sliding rail comprises a first sliding rail and a second sliding rail.

8. The manifold assembly of claim 7, wherein the second sliding rail is positioned substantially parallel to the first sliding rail.

9. The manifold assembly of claim 1, wherein the attachment assembly further comprises a plurality of coupling members configured to couple the second plurality of engagement members to the manifold.

10. The manifold assembly of claim 9, wherein the coupling members are configured to couple to the manifold via an interference fit.

11. The manifold assembly of claim 1, wherein at least a portion of the manifold comprises a flexible section configured to provide for height adjustment of the dish rack.

12. The manifold of claim 11, further comprising a fluid connector configured to couple to the fluid supply, wherein the flexible section of the manifold is configured to engage the fluid connector.

13. The manifold assembly of claim 12, wherein the manifold further comprises a substantially rigid section, wherein the flexible section of the manifold is disposed between the substantially rigid section of the manifold and the fluid connector.

14. The manifold assembly of claim 11, wherein the flexible section of the manifold comprises a rubber hose.

15. The manifold assembly of claim 1, wherein the attachment assembly is coupled to the manifold such that the manifold and the spray device are disposed beneath the dish rack.

16. A dishwasher, comprising:

a washing chamber;

a dish rack disposed in the washing chamber;

a spray device disposed in the washing chamber;

a fluid supply that extends vertically along a rear wall of the washing chamber and is configured to supply a fluid to the spray device;

a manifold assembly, comprising:

a manifold coupled to the fluid supply so as to provide a fluid connection therewith, the manifold extending forwardly from the fluid supply and configured to direct the fluid from the fluid supply to the spray device;

an attachment assembly configured to translatably couple the manifold to a dish rack to enable movement of the dish rack relative to the manifold between a retracted position of the dish rack and an extended position of the dish rack, while maintaining the coupling of the manifold to the dish rack and while maintaining fluid connection with the fluid supply, wherein when the dish rack is in the extended position, at least a portion of the dish rack extends outside of the washing chamber to facilitate dishware being loaded and unloaded therefrom, the attachment assembly comprising:

at least one sliding rail, a first plurality of engagement members configured to couple the at least one sliding rail to the dish rack, and a second plurality of engagement members configured to couple to the manifold and the at least one sliding rail so as to allow movement along the at least one sliding rail along a major axis of the at least one sliding rail, wherein contact between one of the first plurality of engagement members and one of the second plurality of engagement members defines a dish rack travel limit for movement of the dish rack between the retracted position and the extended position.

17. The dishwasher of claim 16, wherein the manifold comprises a flexible section configured to provide for height adjustment of the dish rack within the washing chamber.

18. A method for assembling a dishwasher, comprising the steps of:

providing a dishwasher, comprising:

a washing chamber;

a dish rack disposed in the washing chamber;

a spray device disposed in the washing chamber; and a fluid supply that extends vertically along a rear wall of the washing chamber and is configured to supply a fluid to the spray device;

coupling a manifold to the fluid supply so as to establish a fluid connection therewith, the manifold extending forwardly from the fluid supply; and translatably coupling the manifold to the dish rack so as to enable movement of the dish rack relative to the manifold between a retracted position of the dish rack and an extended position of the dish rack, while maintaining the coupling of the manifold to the dish rack and while maintaining fluid connection with the fluid supply, wherein when the dish rack is in the extended position, at least a portion of the dish rack extends outside of the washing chamber to facilitate dishware being loaded and unloaded therefrom, wherein translatably coupling the manifold to the dish rack comprises:

coupling a first plurality of engagement members to a sliding rail and the dish rack; and coupling a second plurality of engagement members to the manifold and the sliding rail so as to allow movement along the sliding rail along a major axis of the sliding rail, wherein contact between one of the first plurality of engagement members and one of the second plurality of engagement members defines a dish rack travel limit for movement of the dish rack between the retracted position and the extended position.

* * * * *